US006558526B2

(12) United States Patent
D'Astolfo, Jr. et al.

(10) Patent No.: US 6,558,526 B2
(45) Date of Patent: May 6, 2003

(54) METHOD OF CONVERTING HALL-HEROULT CELLS TO INERT ANODE CELLS FOR ALUMINUM PRODUCTION

(75) Inventors: LeRoy E. D'Astolfo, Jr., Lower Burrell, PA (US); Robert C. Moore, Knoxville, TN (US)

(73) Assignee: Alcoa Inc., Pittsburgh, PA (US)

( * ) Notice: Subject to any disclaimer, the term of this patent is extended or adjusted under 35 U.S.C. 154(b) by 100 days.

(21) Appl. No.: 09/792,728

(22) Filed: Feb. 23, 2001

(65) Prior Publication Data

US 2001/0037946 A1 Nov. 8, 2001

Related U.S. Application Data

(60) Provisional application No. 60/184,638, filed on Feb. 24, 2000.

(51) Int. Cl.[7] ..... C25C 3/06; C25C 3/08; C25C 3/20

(52) U.S. Cl. ..... 205/389; 205/396

(58) Field of Search ..... 205/372–389, 205/396; 204/245

(56) References Cited

U.S. PATENT DOCUMENTS

| | | | | |
|---|---|---|---|---|
| 2,480,474 A | | 8/1949 | Johnson | 204/67 |
| 3,126,326 A | | 3/1964 | Frerotti et al. | 204/67 |
| 3,616,317 A | | 10/1971 | McLellan | 204/67 |
| 3,756,929 A | | 9/1973 | Schmidt-Hatting et al. | 204/67 |
| 4,045,307 A | | 8/1977 | Turley | 204/64 |
| 4,097,228 A | | 6/1978 | Rosling | 432/250 |
| 4,187,155 A | | 2/1980 | de Nora et al. | 204/67 |
| 4,261,807 A | | 4/1981 | Blanc | 204/243 |
| 4,342,178 A | | 8/1982 | Benton et al. | 52/125.5 |
| 4,374,050 A | | 2/1983 | Ray | 252/519 |
| 4,374,761 A | | 2/1983 | Ray | 252/519 |
| 4,399,008 A | | 8/1983 | Ray | 204/67 |
| 4,455,211 A | | 6/1984 | Ray et al. | 204/293 |
| 4,504,366 A | * | 3/1985 | Jarrett et al. | 205/372 |
| 4,582,585 A | | 4/1986 | Ray | 204/243 |
| 4,584,172 A | | 4/1986 | Ray et al. | 419/34 |
| 4,592,813 A | | 6/1986 | Henry | 204/67 |
| 4,608,134 A | | 8/1986 | Brown | 204/67 |
| 4,620,905 A | | 11/1986 | Tarcy et al. | 204/64 R |
| 4,622,111 A | * | 11/1986 | Brown et al. | 204/243.1 X |
| 4,687,439 A | | 8/1987 | Olivarez, Jr. et al. | 432/192 |
| 4,992,146 A | | 2/1991 | Skaar et al. | 204/67 |
| 5,330,631 A | * | 7/1994 | Juric et al. | 204/243.1 |
| 5,362,366 A | * | 11/1994 | de Nora et al. | 204/225 X |
| 5,794,112 A | | 8/1998 | Ray et al. | 419/21 |
| 5,865,980 A | | 2/1999 | Ray et al. | 205/367 |
| 5,876,585 A | | 3/1999 | Schenk | 205/390 |
| 5,942,097 A | * | 8/1999 | Rapp | 205/386 |
| 6,126,799 A | | 10/2000 | Ray et al. | 204/291 |
| 6,258,246 B1 | * | 7/2001 | Duruz et al. | 205/379 |

OTHER PUBLICATIONS

A.I. Belyaev Mintsbetmetzoloto, "Electrolysis of Aluminum with Nonburning Ferrite Anodes", L'egkie Metal. 7(1): 7–20, 1938, pp. 1–42 (and English Translation).

* cited by examiner

*Primary Examiner*—Donald R. Valentine
(74) *Attorney, Agent, or Firm*—Alan G. Towner; Edward L. Levine

(57) ABSTRACT

A method is provided for retrofitting conventional aluminum smelting cells with inert anode assemblies which replace the consumable carbon anodes of the cell. The inert anode assemblies are pre-heated prior to introduction into the operating cell. Insulation may be installed for reducing heat loss during operation of the retrofit cells.

13 Claims, 4 Drawing Sheets

METHOD OF CONVERTING HALL-HEROULT CELLS TO INERT ANODE CELLS FOR ALUMINUM PRODUCTION

CROSS REFERENCE TO RELATED APPLICATION

This application claims the benefit of U.S. Provisional Application Ser. No. 60/184,638 filed Feb. 24, 2000.

FIELD OF THE INVENTION

The present invention relates to electrolytic aluminum production cells, and more particularly relates to a method of converting conventional cells containing consumable anodes to cells containing inert anodes.

BACKGROUND INFORMATION

Existing aluminum smelting cells use consumable carbon anodes which produce $CO_2$ and other gaseous by-products and must be frequently replaced. Inert or non-consumable anodes may eliminate these concerns, but the implementation of inert anodes provides other challenges such as controlling the heat balance of the cell. Furthermore, there are thousands of existing conventional cells, which would be cost-prohibitive to replace entirely. An effective procedure is therefore needed to convert conventional Hall-Heroult cells to inert anode cells for aluminum production.

SUMMARY OF THE INVENTION

An aspect of the present invention is to provide a method of retrofitting an aluminum smelting cell. The method includes the steps of removing at least one consumable carbon anode from an operating cell, and replacing the at least one consumable carbon anode with at least one inert anode. The inert anodes may be preheated prior to installation, e.g., to a temperature approximating the bath temperature of the cell. In one embodiment, the anode-cathode distance of the consumable carbon anodes is increased before they are replaced. The inert anodes are then serially installed at an intermediate anode-cathode distance.

These and other aspects of the present invention will be more apparent from the following description.

DETAILED DESCRIPTION

Figure 1:
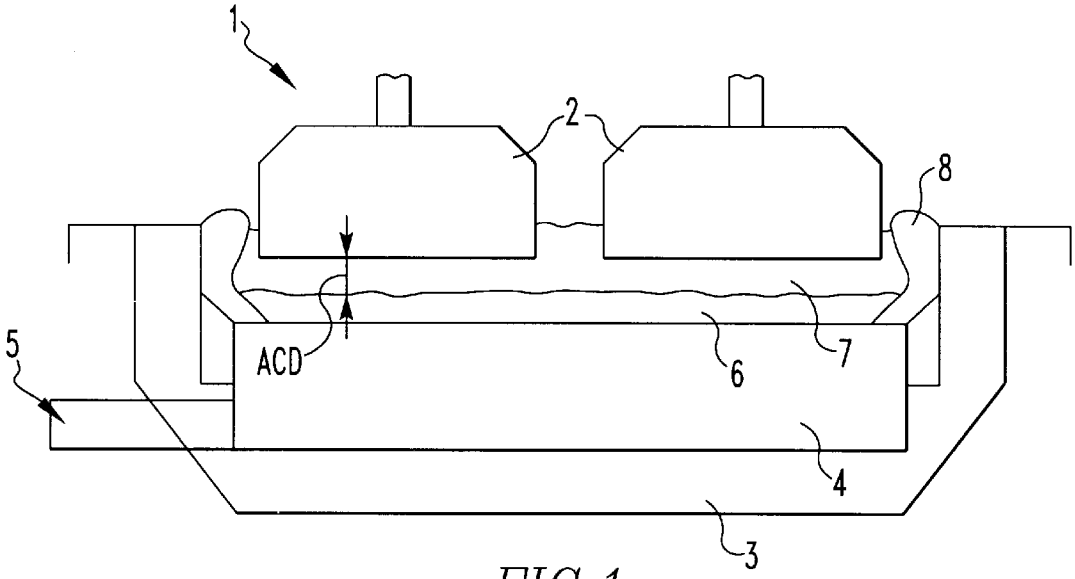
FIG.1 PRIOR ART
FIG. 1 is a partially schematic side view of a conventional aluminum production cell including conventional consumable carbon anodes.

FIG. 1 schematically illustrates a conventional aluminum production cell 1 including consumable carbon anodes 2 which may be replaced with inert anode assemblies in accordance with the present method. The cell 1 includes a refractory material 3 supported by a steel shell. A cathode 4 made of carbon or the like is located on the refractory material 3. A current collector 5 is connected to the cathode 4. During operation of the cell 1, molten aluminum 6 forms on the surface of the cathode 4. The consumable carbon anodes 2 are immersed in an electrolytic bath 7 at a level defined by an anode-cathode distance ACD. A frozen crust 8 of bath material typically forms around the sides of the cell 1.

Figure 2:
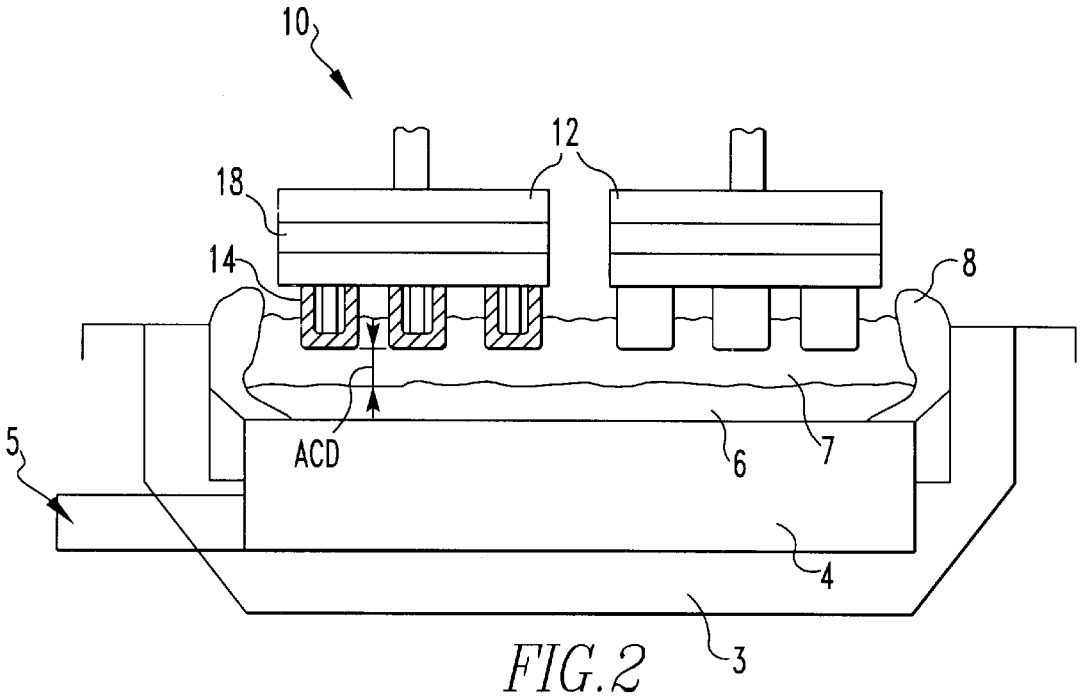
FIG. 2 is a partially schematic side view of an aluminum production cell retrofit with inert anode assemblies in accordance with an embodiment of the present invention.

FIG. 2 illustrates an aluminum production cell 10 that has been retrofitted with inert anode assemblies 12 in accordance with an embodiment of the present method. The inert anode assemblies 12 shown in FIG. 2 replace the conventional consumable carbon anodes 2 shown in FIG. 1. The inert anode assemblies 12 are immersed in the electrolytic bath at a level defined by the anode-cathode distance ACD. Each carbon anode 2 may be replaced with a single inert anode assembly 12, as illustrated in FIGS. 1 and 2. Alternatively, the retrofit cell 10 may include more or less inert anode assemblies 12 in comparison with the number of carbon anodes 2 used in the conventional cell 1.

As shown in FIG. 2, each inert anode assembly 12 which may replace a consumable carbon anode includes a substantially horizontal array of inert anodes 14 positioned below thermal insulation material 18. An inwardly extending peripheral lip (not shown) may optionally be provided around the upper edge of the cell 10 between the steel shell or refractory material 3 and the inert anode assemblies 12 in order to provide additional thermal insulation.

Figure 3:
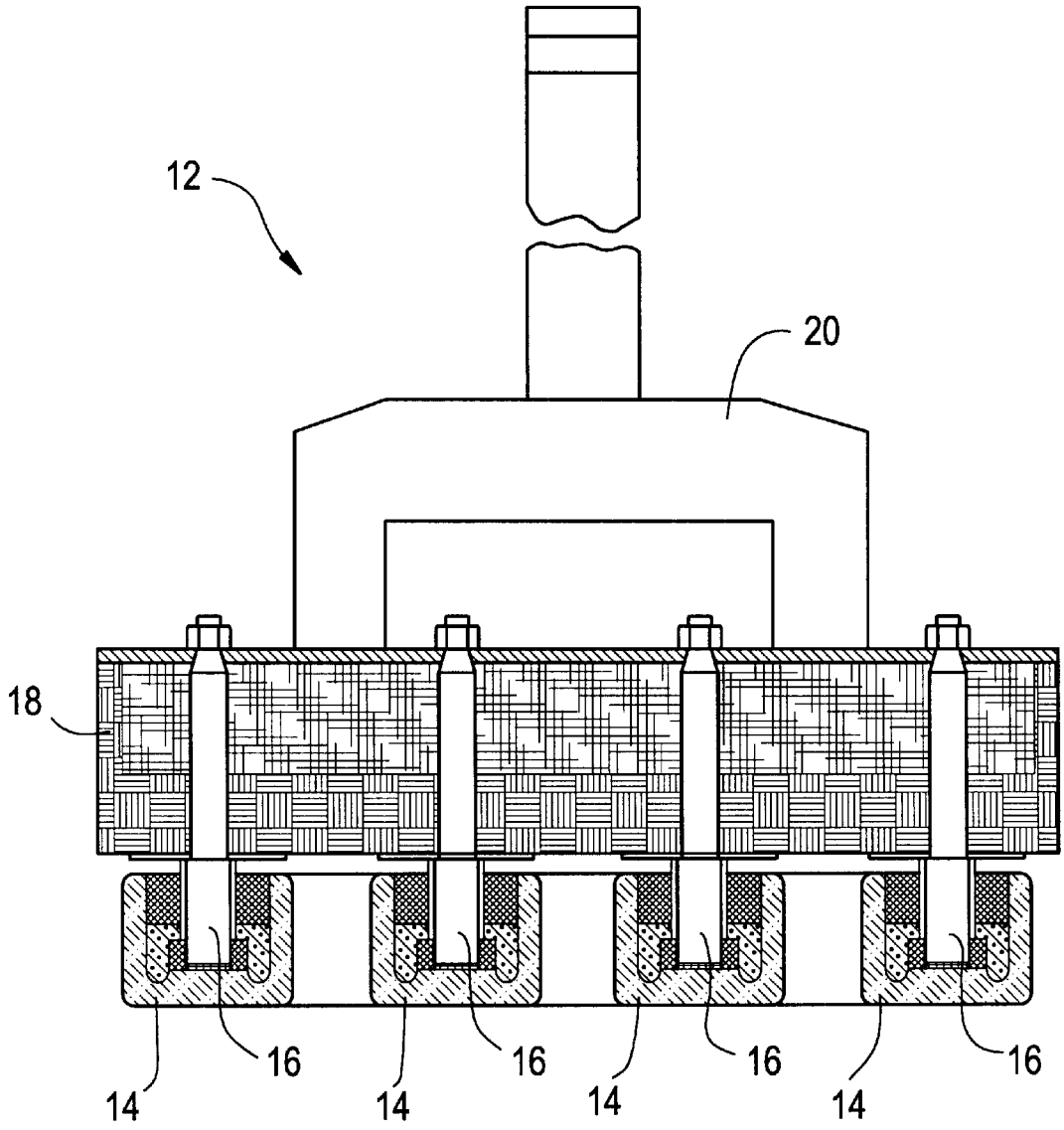
FIG. 3 is a side sectional view of an inert anode assembly intended to replace a conventional consumable carbon anode in accordance with an embodiment of the present invention.
Figure 4:
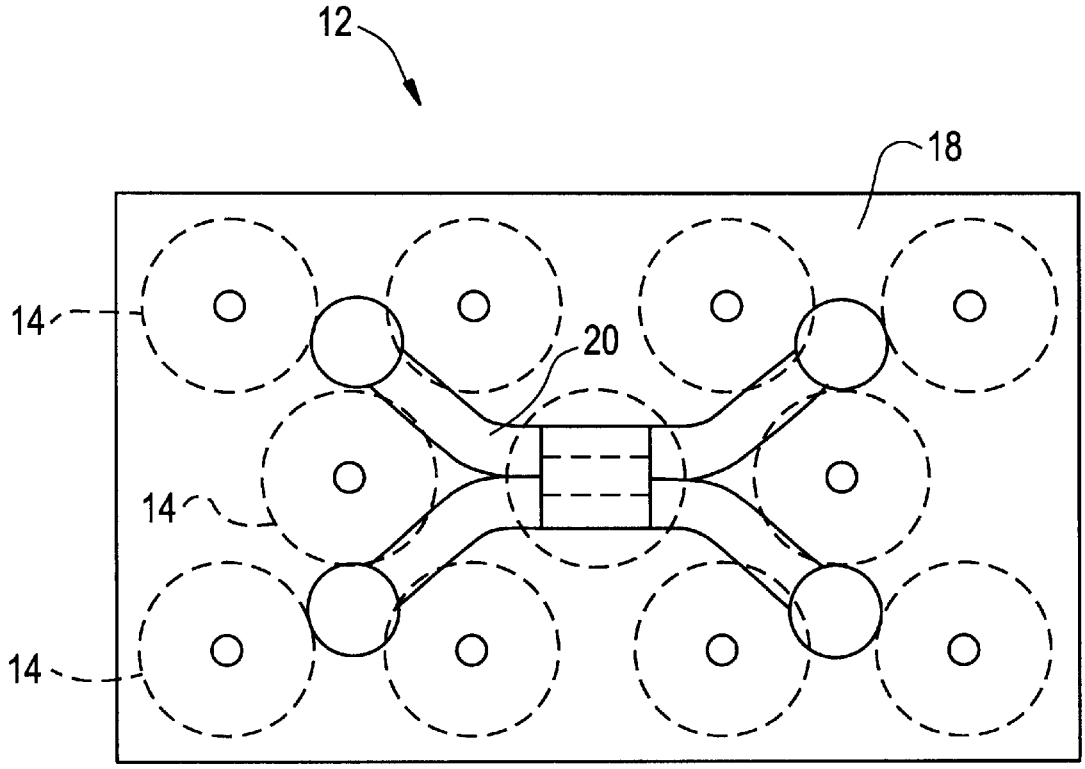
FIG. 4 is a top view of the inert anode assembly of FIG. 3.

FIGS. 3 and 4 illustrate an inert anode assembly 12 which may be installed in a cell in accordance with an embodiment of the present invention. The assembly 12 includes a substantially horizontal array of inert anodes 14. In the embodiment shown in FIGS. 3 and 4, eleven staggered inert anodes 14 are used. However, any suitable number and arrangement of inert anodes may be used. As shown in FIG. 3, each inert anode 14 is electrically and mechanically fastened by a connector 16 to an insulating lid 18. The insulating lid 18 is connected to an electrically conductive support member 20.

Any desired inert anode shape or size may be used. For example, the substantially cylindrical cup-shaped inert anodes 14 shown in FIGS. 3 and 4 may have diameters of from about 5 to about 30 inches and heights of from about 5 to about 15 inches. The composition of each inert anode 14 may include any suitable metal, ceramic, cermet, etc. which possesses satisfactory corrosion resistance and stability during the aluminum production process. For example, inert anode compositions disclosed in U.S. Pat. Nos. 4,374,050, 4,374,761, 4,399,008, 4,455,211, 4,582,585, 4,584,172, 4,620,905, 5,794,112 and 5,865,980, and U.S. patent application Ser. No. 09/629,332 filed Aug. 1, 2000, each of which is incorporated herein by reference, may be suitable for use in the inert anodes 14. Particularly preferred inert anode compositions comprise cermet materials including an Fe—Ni—Zn oxide or Fe—Ni—Co oxide phase in combination with a metal phase such as Cu and/or Ag. Each inert anode 14 may comprise a uniform material throughout its thickness, or may include a more corrosion resistant material in the regions exposed to the electrolytic bath. Hollow or cup-shaped inert anodes may be filled with protective material, as shown in FIG. 3, in order to reduce corrosion of the connectors and the interface between the connectors and the inert anodes.

The connectors 16 may be made of any suitable materials which provide sufficient electrical conductivity and mechanical support for the inert anodes 14. For example, each connector 16 may be made of Inconel. Optionally, a highly conductive metal core such as copper may be provided inside an Inconel sleeve. The connectors 16 may be attached to the inert anodes 14 by any suitable means such as brazing, sintering and mechanical fastening. For example, a connector comprising an Inconel sleeve and a copper core may be attached to a cup-shaped inert anode by filling the bottom of the inert anode with a mixture of copper powder and small copper beads, followed by sintering of the mixture to attach the copper core to the inside of the anode. Each connector 16 may optionally include separate components for providing mechanical support and supplying electrical current to the inert anodes 14.

In accordance with a preferred embodiment, insulation is used in order to conserve a substantial portion of the heat presently lost from conventional cells, while at the same time avoiding undesirable increases in total voltage. An insulation package may be installed on top of the cell which can survive under severe conditions. As shown in the embodiment of FIG. 3, the insulating lid 18 may mechanically support and provide an electrical connection to each connector 16. The insulating lid 18 preferably includes one or more thermal insulating layers of any suitable composition(s). For example, a highly corrosion resistant refractory insulating material may be provided on the exposed regions of the insulating lid 18, while a material having higher thermal insulation properties may be provided in the interior regions. The insulating lid 18 may also include an electrically conductive metal plate which provides a current path from the conductive support member 20 to the connectors 16, as shown in FIG. 3. The conductive metal plate may be at least partially covered with a thermally insulating and/or corrosion resistant material (not shown). Although not shown in FIG. 3, electrically conductive elements such as copper straps may optionally be provided between the conductive support member 20 and connectors 16.

Figure 5:
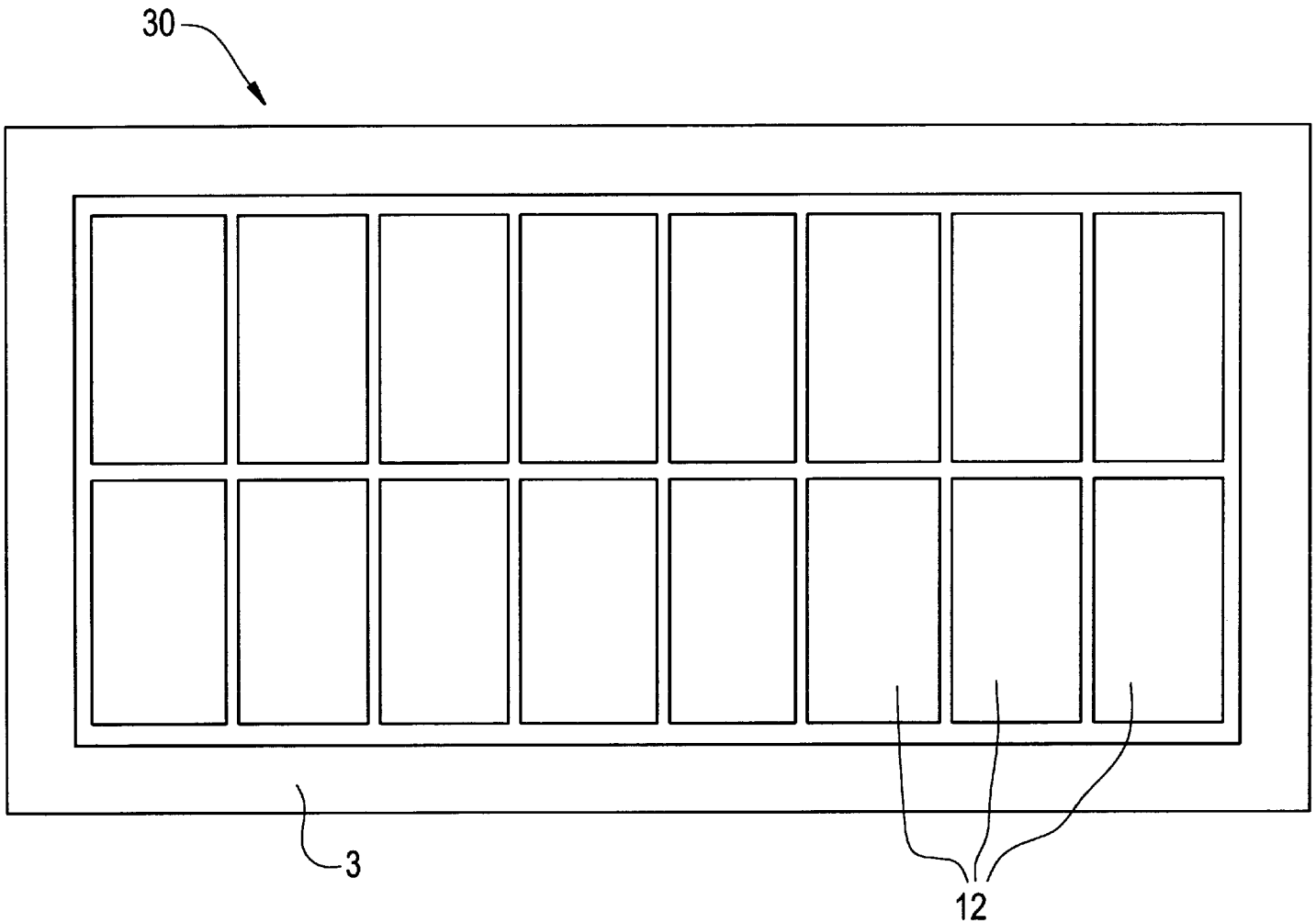
FIG. 5 is a partially schematic plan view of an aluminum production cell including an array of inert anode assemblies which may be installed in accordance with an embodiment of the present invention.

FIG. 5 illustrates the top of a cell 30 that has been retrofitted with inert anode assemblies 12 in accordance with an embodiment of the present invention. The retrofitted cell 30 may consist of a conventional Hall-Heroult design, with a cathode and insulating material 3 enclosed in a steel shell. Each conventional carbon anode has been replaced by an inert anode assembly 12, and otherwise attached to the bridge in the normal manner. The inert anode assemblies 12 may consist of a metallic distributor plate which distributes current to an array of anodes through a metallic conductor pin attached at either end to the plate and anode, as previously described in the embodiment of FIGS. 3 and 4.

In the embodiment shown in FIG. 5, the retrofit cell 10 contains an array of sixteen inert anode assemblies 12. Each assembly 12 replaces a single consumable carbon anode of the cell. The inert anode assemblies 12 may each include multiple inert anodes, e.g., as shown in FIG. 4. During the anode replacement operation, the original consumable carbon anodes may be serially replaced with an inert anode assembly 12. The cell 10 may be divided into sectors which contain multiple consumable carbon anodes. For example, the cell 10 of FIG. 5 may be divided into quadrants which each contain four consumable anodes. The anodes in one quadrant may be replaced, followed by the anodes in another quadrant, etc. Alternatively, the anodes may be replaced serially from one end of the cell to an opposite end of the cell. As another example, the anodes may be serially replaced from a central area of the cell toward outward areas of the cell.

A conversion procedure in accordance with the present invention is as follows: serially replace all carbon anodes with inert anode assemblies in an operating cell or pot; and replace any existing cover material with an anode cover such as insulation packages and/or a mixture of alumina and crushed bath. Optionally, the pot may be operated for a time period until the carbon level in the bath is reduced to a minimum stable level, and the initial set of the inert anode assemblies may be replaced with a permanent set of inert anode assemblies. In this embodiment, the initial set of inert anode assemblies may provide a transitional set for other pot conversions.

The following step-by-step conversion process may be used:

(1) Adjust alumina content of bath to 5.5 to 8.5 percent, preferably 6.2 to 6.8 percent, depending on ratio and temperature;

(2) Increase anode-cathode distance of carbon anodes to compensate for increased resistance of inert anodes;

(3) Increase cell temperature, e.g., from 5 to 30 degrees C., above normal operating temperature to compensate for heat loss during operations such as desludging and anode cleaning;

(4) Preheat inert anode assemblies to approximately cell temperature in separate furnace with a ramp rate not exceeding 100 degrees C. per hour;

(5) Break crust around carbon anodes to be replaced, and remove anodes;

(6) Clean out chunks of bath and anode pieces from open anode position.

(7) Remove equivalent inert anode from preheat furnace and quickly install into vacant position in place of carbon anode;

(8) Install insulated side and center covers corresponding to anode position being replaced;

(9) Adjust height of equivalent inert anode assembly to produce comparable current load as carbon anodes;

(10) Continue to replace carbon anodes with equivalent inert anodes; and

(11) Operate cell normally and monitor carbon and carbide content of bath.

To convert a Hall cell running on carbon anodes to one operating on inert anodes it is desirable to change all the anodes within a short period of time, e.g., 4–8 hours. If longer times are taken the carbon anodes in the cell can adversely effect the inert anodes as they are being changed and make the useful life of the inert anodes much shorter than their potential.

Inert anodes made of cermet materials may be prone to thermal shock cracking. Therefore they should be preheated to approximately the operating temperature of the pot before they can be exchanged with a carbon anode. A preferred method for achieving a full pot change out of inert anodes is to convert an existing pot at a location in the line close to the pot to be changed out into a gas fired furnace to preheat all the anodes at one time. The anodes could be supported by the existing super-structure and the pot lining changed to provide a direct or indirect heating of the anodes. For example, the energy system to be used may be a gas baking system conventionally used in potrooms to preheat a completely relined carbon pot prior to the introduction of the bath material and reconnecting it to the bus work for current passage. Alternatively, preheating furnaces, fired by gas, oil or electricity may be provided for each individual inert anode assembly. Preheated anode assemblies may be transported by standard anode-changing cranes from a central location in the potroom or transported to the near vicinity of the cell being retrofitted.

In accordance with an embodiment of the present invention, the anode-cathode distance (ACD) of the consumable carbon anodes and the inert anodes may be adjusted during the retrofitting operation. Initially, the consumable carbon anodes may be positioned at a first ACD which is subsequently increased to a second ACD prior to replacement with the inert anodes. The second ADC may be from about 10 to about 100 percent greater than the first ACD, typically from about 40 to about 80 percent greater. The inert anodes may then be installed in the cell at a third ACD, which is typically between the first and second ACDs. Upon installation of all of the inert anodes in the cell, the ACD of the inert anodes may be adjusted as desired. For example, the inert anodes may be lowered to a fourth ACD less than the third ACD.

As a particular example, inert anodes positioned at the same ACD as carbon anodes may require 0.60 V extra pot voltage due to higher back emf of the inert anodes. This extra voltage does not provide heating energy. To regain stability with carbon anode pots, an increase in ACD, e.g., of 18 mm (from 40 mm to 58 mm, pot volts from 4.50 V to 5.25 V) may be needed. The following setting heights are based on finishing the anode changeover with inert anode ACD's at 58 mm. The pot volts and ACD can subsequently be decreased if desired, depending on pot conditions. Just prior to anode changeover, the anode bridge may be raised to increase the ACD and the pot voltage from 4.50 V to 5.50 V. The carbon anode ACD's may be raised from 40 mm to 65 mm (a rule of thumb is 25 mm=1.00 V). On the first carbon anode for removal, reference marks may be placed on the connector rod. The carbon anode may then be removed and placed on anode setting gauging frame. Using a swing arm or other suitable device, the distance from the anode bottom may be measured. The first inert anode to be installed in the cell may be set at a height, e.g., 8 mm, lower than the carbon anode it replaces. The reason to set the inert anodes slightly lower than the carbon anodes is to prevent the carbon anodes (lower back emf) from taking an extreme share of the current as more and more inert anodes replace the remaining carbon anodes. When all the inert anodes are set, the ACD's will be approximately 58 mm, with a pot voltage of 5.85 V. As pot conditions allow, voltages may be reduced, e.g., from 5.85 V to 5.10 V (ACD's decreased from 58 mm to 40 mm). Pot voltages and ACD's may further be adjusted as heat balance and stability permit.

During and after the anode replacement operation, suitable cell operation parameters may be, for example, a bath height of 15 to 18 cm, a metal height of 25 to 35 cm, a temperature of about 960 degrees C., an $ALF_3$ percentage of 9.0%, and an alumina percentage of 6.2 to 6.8%.

In accordance with the present invention, inert anode assemblies may be used to replace consumable carbon anodes in conventional aluminum production cells with little or no modifications to the other components of the cell, such as the cathode, refractory insulation or steel shell. It is desired to minimize the cost of the retrofit by, e.g., not incurring added cost of furnaces and auxiliary equipment while achieving a successful change out of the carbon anodes. In accordance with the present invention, cell shutdown and the resultant loss of production are avoided. In addition, rebuilding of the cell is avoided. The present invention provides several advantages, including the capital savings achieved from avoidance of major modifications or total replacement of existing cells.

Whereas particular embodiments of this invention have been described above for purposes of illustration, it will be evident to those skilled in the art that numerous variations of the details of the present invention may be made without departing from the invention as defined in the appended claims.

What is claimed is:

1. A method of retrofitting an aluminum smelting cell, the method comprising:

removing at least one consumable carbon anode from an operating cell, and replacing the at least one consumable carbon anode with at least one inert anode which is preheated at a ramp rate of 100 degrees C. per hour or less prior to installation in the cell.

2. The method of claim 1, wherein the at least one consumable carbon anode is positioned at a first anode-cathode distance, and the first anode-cathode distance is increased to a second anode-cathode distance prior to replacement of the at least one consumable carbon anode with the at least one inert anode.

3. The method of claim 2, wherein the second anode-cathode distance is from about 10 to about 100 percent greater than the first anode-cathode distance.

4. The method of claim 2, wherein the second anode-cathode distance is from about 40 to about 80 percent greater than the first anode-cathode distance.

5. The method of claim 2, wherein the at least one inert anode is installed in the cell at a third anode-cathode distance.

6. The method of claim 5, wherein the third anode-cathode distance is between the first and second anode-cathode distances.

7. The method of claim 5, wherein the at least one inert anode is subsequently lowered to a fourth anode-cathode distance less than the third anode-cathode distance.

8. The method of claim 1, wherein a plurality of the consumable carbon anodes are initially contained in the cell and positioned at a first anode-cathode distance, and the first anode-cathode distance is increased to a second anode-cathode distance prior to replacement of the consumable carbon anodes with the inert anodes.

9. The method of claim 8, wherein the inert anodes are serially installed in the cell at a third anode-cathode distance between the first and second anode-cathode distances.

10. The method of claim 9, wherein the inert anodes are subsequently lowered to fourth anode-cathode distance less than the third anode-cathode distance.

11. The method of claim 1, further comprising increasing the temperature of the cell prior to removal of the at least one consumable carbon anode.

12. The method of claim 11, wherein the temperature of the cell is increased by about 5 to about 30 degrees C.

13. The method of claim 1, wherein the at least one inert anode is preheated to a temperature approximating a temperature of molten bath in the cell.

* * * * *